US008360753B2

(12) United States Patent
Lee et al.

(10) Patent No.: US 8,360,753 B2
(45) Date of Patent: Jan. 29, 2013

(54) MICRO FLUIDIC TRANSPORTATION DEVICE AND METHOD FOR MANUFACTURING THE SAME

(75) Inventors: Dae-Sik Lee, Daejon (KR); Sung-Lyul Maeng, Chungbuk (KR); Jack Luo, Cambridgeshire (GB); Bill Milne, Cambridgeshire (GB)

(73) Assignee: Electronics and Telecommunications Research Institute, Daejon (KR)

( * ) Notice: Subject to any disclaimer, the term of this patent is extended or adjusted under 35 U.S.C. 154(b) by 416 days.

(21) Appl. No.: 12/517,602

(22) PCT Filed: Dec. 4, 2007

(86) PCT No.: PCT/KR2007/006254

§ 371 (c)(1),
(2), (4) Date: Jun. 4, 2009

(87) PCT Pub. No.: WO2008/069551

PCT Pub. Date: Jun. 12, 2008

(65) Prior Publication Data

US 2010/0018596 A1 Jan. 28, 2010

(30) Foreign Application Priority Data

Dec. 5, 2006 (KR) ..... 10-2006-0122491
Aug. 21, 2007 (KR) ..... 10-2007-0083835

(51) Int. Cl.
*F04B 17/00* (2006.01)

(52) U.S. Cl. ..... 417/413.2

(58) Field of Classification Search ..... 417/413.2
See application file for complete search history.

(56) References Cited

U.S. PATENT DOCUMENTS 6,981,759 B2 1/2006 Chen
2004/0231736 A1 11/2004 Kim et al.

FOREIGN PATENT DOCUMENTS

KR 10-0453815 B1 3/2007

OTHER PUBLICATIONS

Onur Tigli, et al; "Design and Fabrication of a novel SAW Bio/Chemical Sensor in CMOS", Sensors, 2005 IEEE, Nov. 2005, pp. 137-140.

Xiafu Lu, et al; "The Small Volume Liquid Density Sensor Using Surface Acoustic Wave", Proceedings of the 2006 IEEE International Conference on Mechatronics and Automation, Jun. 25-28, 2006, pp. 2105-2110.

A. Renaudin, et al; "SAW nonopump for handling droplets in view of biological applications", Sensors and Actuators B, vol. 113, Issue 1, Jan. 17, 2006, pp. 389-397.

Zeno Guttenberg, et al; "Planar chip device for PCR and hybridization with surface acoustic wave pump", The Royal Society of Chemistry Journal, 2005, Lab Chip, 2005, 5, pp. 308-317.

International Search Report; dated Dec. 4, 2007; PCT/KR2007/006254.

*Primary Examiner* — Anh Mai
*Assistant Examiner* — Brenitra Lee
(74) *Attorney, Agent, or Firm* — Ladas & Parry LLP

(57) ABSTRACT

Provided is a micro fluidic transportation device capable of controlling discontinuous transportation of micro droplets using surface acoustic wave (SAW), and a method for manufacturing the same. The micro fluidic transportation device which includes: a substrate; a piezoelectric layer formed on the substrate; an inter digitated transducer (IDT) electrode formed on the piezoelectric layer for energy conversion by generating a surface acoustic wave (SAW); and a fluid passage formed on the piezoelectric thin layer.

20 Claims, 7 Drawing Sheets

MICRO FLUIDIC TRANSPORTATION DEVICE AND METHOD FOR MANUFACTURING THE SAME

TECHNICAL FIELD

The present invention relates to a micro fluidic transportation device and a method for manufacturing the same; and, more particularly, to a micro fluidic transportation device capable of controlling discontinuous transportation of micro droplets using surface acoustic wave (SAW), and a method for manufacturing the same.

BACKGROUND ART

Various studies have been carried out on biological, electromechanical micro devices such as a lab-on-a-chip device for the purposes of miniaturization, cost reduction, integration, automation, and real time diagnosis. Particularly, many studies are recently carried out on biochips or biosensors for biochemical analysis. Since many expensive reaction samples are used in such biochips or biosensors for detecting specific biomaterials from bio samples or analyzing specific biomaterials, there is an increasing need for a reliable and inexpensive micro fluidic transportation device that can be used for detecting and analyzing a specific biomaterial using a small amount of a reaction sample without influences by environmental pollutants.

Various methods have been proposed for efficient transportation of micro amounts of fluid. Examples of such methods include: mechanical pumping; thermal pumping using thermal expansion; micro-actuator pumping; electrochemical pumping such as electrophoretic pumping for transporting micro amounts of fluid using a voltage applied to a micro channel, and electro-osmotic pumping; and capillary flow pumping using paraffin and a capillary jack valve.

In micro fluidic transportation devices using such pumping methods, only a portion of an expensive reaction sample reacts with a biological sample since the samples flow during the reaction. Furthermore, an additional device is necessary to disperse proteins or DNAs included in the biological sample or maintain the proteins or DNAs at a dispersed state.

To address these problems, a micro fluidic transportation device has been disclosed in Lab on a chip, 2005, vol 5, pp. 308-317 by the Advalytix company, Germany. The disclosed micro fluidic transportation device uses a piezoelectric substrate formed of a piezoelectric material ($LiNbO_3$) and surface acoustic wave (SAW) to control transportation of nano litters of fluid.

However, the micro fluidic transportation device proposed by Advalytix is expensive and is not suitable for use in disposable biochips or biosensors since the proposed micro fluidic transportation device uses a piezoelectric substrate that is expensive compared with silicon, glass, and plastic substrates. Furthermore, it is difficult to process the piezoelectric substrate with existing semiconductor manufacturing equipment designed based on silicon substrates.

Therefore, there is a need for an inexpensive micro fluidic transportation device for controlling transportation of micro amounts of fluid in a lab-on-a-chip type device such as a disposable biochip or biosensor for biochemical analysis.

DISCLOSURE OF INVENTION

Technical Problem

An embodiment of the present invention is directed to providing a surface acoustic wave (SAW) based micro fluidic transportation device suitable for mass production with low costs using existing semiconductor manufacturing technology, and a method for manufacturing the micro fluidic transportation device.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with an aspect of the present invention, there is provided a micro fluidic transportation device, which includes: a substrate; a piezoelectric thin layer formed on the substrate; an inter digitated transducer (IDT) electrode formed on the piezoelectric thin layer for energy conversion by generating a surface acoustic wave (SAW); and a fluid passage formed on the piezoelectric thin layer.

The micro fluidic transportation device may further include a sensor for detecting information about a reaction between a detector and a micro fluid flowing in the fluid passage, and the sensor includes one selected from the group consisting of a nanowire, a carbon nanotube, a thin film resistor, a quantum dot, a transistor, a diode, and an SAW device.

The substrate may be formed of a material selected from the group consisting of silicon, glass, plastic, and metal. The piezoelectric thin layer may have a thickness ranging from approximately 0.5 μm to approximately 10 μm.

The piezoelectric thin layer may be formed of a material selected from the group consisting of zinc oxide (ZnO), aluminum nitride (AlN), lithium niobium oxide ($LiNbO_3$), lithium tantalum oxide ($LiTaO_3$), quartz.

The IDT electrode may be formed of a material selected from the group consisting of gold (Au), silver (Ag), aluminum (Al), platinum (Pt), tungsten (W), nickel (Ni), copper (Cu), and a combination thereof. The fluid passage may include a hydrophobic surface. The fluid passage may be formed of one of diamond like carbon (DLC) and silane.

In accordance with an aspect of the present invention, there is provided a method for manufacturing a micro fluidic transportation device, the method comprising the steps of: a) forming a piezoelectric thin layer on a substrate; b) forming an IDT electrode on the piezoelectric thin layer for energy conversion; and c) forming a fluid passage on the piezoelectric thin layer. The substrate may be formed of a material selected from the group consisting of silicon, glass, plastic, and metal.

The step of a) forming a piezoelectric thin layer on a substrate includes the steps of: a1) depositing a piezoelectric thin layer on the substrate; and a2) heat-treating the piezoelectric thin layer to reduce stresses and improve crystal characteristics.

The step a1) of depositing a piezoelectric thin layer on the substrate may be performed using one selected from the group consisting of reactive sputtering, chemical vapor deposition (CVD), molecular beam epitaxy (MBE), and atomic layer deposition (ALD). The step of a2) heat-treating the piezoelectric thin layer may be performed at a temperature of approximately 400° C. in an oxygen ($O_2$) or argon (Ar) atmosphere for approximately 10 minutes.

The step of c) forming a fluid passage on the piezoelectric thin layer may include the steps of: c1) depositing a fluid passage layer on the piezoelectric thin layer; and c2) patterning the fluid passage layer.

The fluid passage may include a hydrophobic surface, and the fluid passage may be formed of one of DLC and silane.

The method may further include the step of: d) forming a sensor for detecting information about a reaction between a detector and a micro fluid flowing in the fluid passage. Herein, the sensor includes one selected from the group consisting of a nanowire, a carbon nanotube, a thin film resistor, a quantum dot, a transistor, a diode, and an SAW device.

ADVANTAGEOUS EFFECTS

In accordance with the present invention, the SAW based micro fluidic transportation device is inexpensive and suitable for mass production since the micro fluidic transportation device uses the piezoelectric thin layer formed on the inexpensive substrate instead of an expensive piezoelectric substrate and can be manufactured using existing silicon based semiconductor manufacturing technology.

Furthermore, since transportation of micro amounts of fluid can be controlled using the SAW based the micro fluidic transportation device, expensive samples can be saved.

In addition, since the micro fluidic transportation device generates and controls SAWs in an electrical manner, the operation of the micro fluidic transportation device can be simple.

Moreover, since the micro fluidic transportation device can transport micro amounts of fluid, the micro fluidic transportation device can be used for various micro fluidic bio devices such as a polymerase chain reaction (PCR) chip, a DNA lab-on-a-chip device, and a micro biological/chemical reactor.

MODE FOR THE INVENTION

Figure 1:
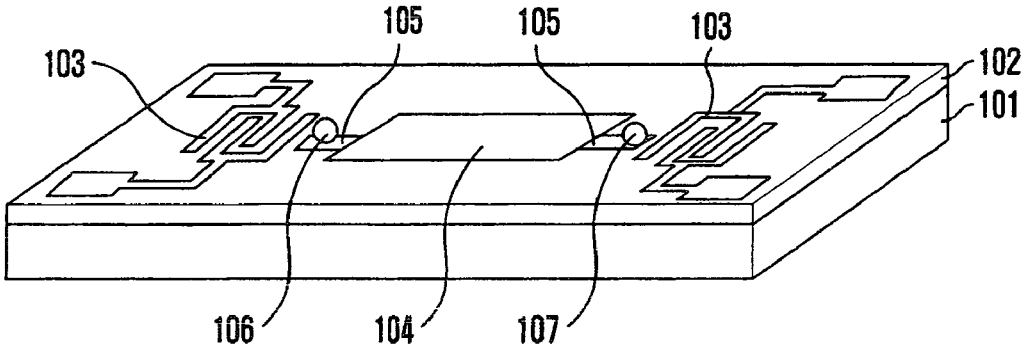
FIG. 1 is a perspective view of a micro fluidic transportation device based on a surface acoustic wave (SAW) in accordance with an embodiment of the present invention.

The advantages, features and aspects of the invention will become apparent from the following description of the embodiments with reference to the accompanying drawings, which is set forth hereinafter. Therefore, those skilled in the field of this art of the present invention can embody the technological concept and scope of the invention easily. In addition, if it is considered that detailed description on a related art may obscure the points of the present invention, the detailed description will not be provided herein.

The preferred embodiments of the present invention will be described in detail hereinafter with reference to the attached drawings. In the drawings, the thicknesses of layers and regions are exaggerated for clarity, and it will also be understood that when a layer is referred to as being disposed on another layer or substrate, it can be directly on the other layer or substrate, or intervening layers may also be present. Like reference numerals in the drawings denote like elements.

FIG. 1 is a perspective view of a micro fluidic transportation device using a surface acoustic wave (SAW) in accordance with an embodiment of the present invention.

Referring to FIG. 1, the micro fluidic transportation device includes a substrate 101, a piezoelectric thin layer 102 formed on the substrate 101, inter digitated transducer (IDT) electrodes 103 formed on the piezoelectric thin layer 102 to generate SAWs for energy conversion, and fluid passages 105 formed on the piezoelectric thin layer 102.

The micro fluidic transportation device can further include a sensor 104 for obtaining information about reactions between detectors and a micro fluid flowing through the fluid passages 105. The sensor 104 can be formed using various sensor materials and devices according to detection target substances and the purpose of detection.

For example, the sensor 104 can be formed using a material or device capable of detecting biological reaction information using an antigen-antibody nonspecific reaction or the complementary binding of DNA. For example, the sensor 104 can be formed of one selected from the group consisting of nanowires, carbon nanotubes, a thin film resistor, quantum dots, a transistor, a diode, and an SAW device.

The substrate 101 can be formed of an inexpensive material. The substrate 101 may be formed of one selected from the group consisting of silicon, glass, plastic, and metal. In addition, the substrate 101 may be formed of a material having a hard surface.

The piezoelectric thin layer 102 can be formed of a piezoelectric material. For example, the piezoelectric thin layer 102 can be formed of one selected from the group consisting of zinc oxide (ZnO), lithium niobium oxide ($LiNbO_3$), lithium tantalum oxide ($LiTaO_3$), quartz, and aluminum nitride (AlN). In addition, the piezoelectric thin layer 102 can have a stacked structure with one or more of the above-mentioned materials. The piezoelectric thin layer 102 may have a thickness ranging from approximately 0.5 μm to approximately 10 μm.

The IDT electrodes 103 convert input energy into an SAW. This energy conversion can be explained as follows: when an electric signal such as a radio frequency (RF) signal is input through input electrodes, piezoelectric distortion occurs at overlapped portions of the IDT electrodes 103 by the piezoelectric effect, and the piezoelectric distortion is transmitted to the piezoelectric thin layer 102 to generate an SAW.

One or more IDT electrodes 103 can be formed according to the direction in which a given sample to be controlled. For example, when two IDT electrodes 103 are formed at left and right sides of the piezoelectric thin layer 102 as shown in FIG. 1, a sample can be controlled in left and right directions.

The IDT electrodes 103 can be formed of a conductive material. For example, the IDT electrodes 103 can be formed of one selected from the group consisting of gold (Au), silver (Ag), aluminum (Al), platinum (Pt), tungsten (W), nickel (Ni), copper (Cu), and a combination thereof.

The fluid passages 105 can be formed in the form of a thin layer. The fluid passages 105 may have hydrophobic surfaces to change a fluid injected into the micro fluidic transportation device into micro droplets for efficient micro fluidic transportation.

The fluid passages 105 can be formed using an organic material such as diamond like carbon (DLC) and silane. Since the DLC is chemically stable, a micro fluid may not react with the DLC. Furthermore, since the DLC has a smooth surface, micro fluidic transportation on the DLC may be efficient.

An operation of the micro fluidic transportation device in accordance with an embodiment of the present invention will be described below.

Micro amounts of a sample are respectively injected to the fluid passages 105 using a fluid control dispensing device. The injected sample can include a biological sample 106 and a reaction sample 107. The biological sample 106 may include an analysis target substance. For example, the biological sample 106 may include blood, a gastric cancer indicator such as alpha-fetoproteine (AFP), a lung cancer indicator such as carcinoembroynic antigen (CEA), or a hormone related to acquired immune deficiency syndrome (AIDS) or pregnancy.

The reaction sample 107 is used to detect a specific substance from the biological sample 106. The sample injected into the fluid passages 105 form droplets owing to the surface property of the fluid passages 105 that are formed using an organic material such as DLC. Next, an electric signal is applied to the IDT electrodes 103 to move the sample from the fluid passages 105 to the sensor 104 in a desired direction. That is, the biological sample 106 and the reaction sample 107 can react with each other in a desired region of the sensor 104 by controlling the electric signal applied to the left and right IDT electrodes 103.

In accordance with the present invention, the SAW-based micro fluidic transportation device includes the piezoelectric thin layer 102 formed on the inexpensive substrate 101 using commercialized silicon-based semiconductor manufacturing technology. That is, an expensive piezoelectric substrate is not used for manufacturing the micro fluidic transportation device. Therefore, the micro fluidic transportation device can be inexpensive and suitable for mass production.

Furthermore, in accordance with the present invention, an SAW is generated and controlled in an electric manner so that the operation of the SAW-based micro fluidic transportation device can be simple.

Moreover, in accordance with the present invention, the micro fluidic transportation device can transport micro amounts of fluid. Therefore, the micro fluidic transportation device can be used for various micro fluidic bio apparatuses such as a polymerase chain reaction (PCR) chip, a DNA lab-on-a-chip, and a micro biological/chemical reactor.

A method for manufacturing a micro fluidic transportation device will now be described in detail with reference to the accompanying drawings.

In the following description, well-known functions or constructions are not described in detail. In the following description, well-kwon methods of manufacturing semiconductor devices or forming layers in semiconductor devices are not described in detail since they would obscure the invention in unnecessary detail. The spirit and scope of the present invention is not limited by the well-known methods.

FIGS. 2 to 5 are cross-sectional views, taken along line X-X' of FIG. 1, showing a method for manufacturing an SAW-based micro fluidic transportation device in accordance with an embodiment of the present invention.

Figure 2:
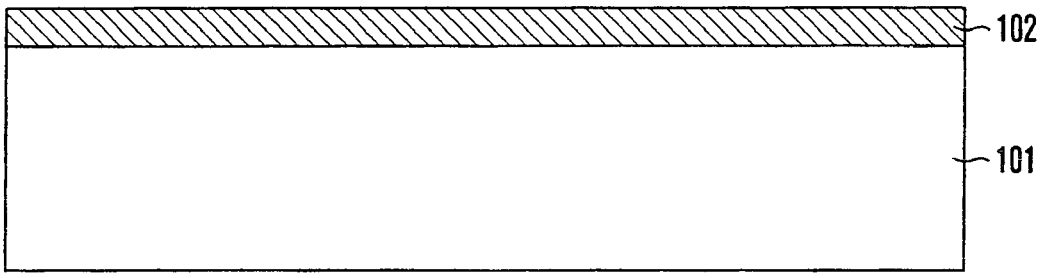
FIGS. 2 to 5 are cross-sectional views, taken along line X-X of FIG. 1, showing a method for manufacturing a micro fluidic transportation device in accordance with an embodiment of the present invention.

Referring to FIG. 2, a piezoelectric thin layer 102 is formed on a substrate 101. The substrate 101 may be a substrate formed of an inexpensive material selected from the group consisting of silicon, glass, plastic, and metal.

The piezoelectric thin layer 102 can be formed of a piezoelectric material. For example, the piezoelectric thin layer 102 can be formed of a material selected from the group consisting of a zinc oxide (ZnO), an aluminum nitride (AlN), a lithium niobium oxide ($LiNbO_3$), a lithium tantalum oxide ($LiTaO_3$), and quartz. In addition, the piezoelectric thin layer 102 can have a stacked structure formed of one or more of the above-mentioned materials. The piezoelectric thin layer 102 may have a thickness in the range from approximately 0.5 μm to approximately 10 μm.

The piezoelectric thin layer 102 can be formed by a method selected from the group consisting of reactive sputtering, chemical vapor deposition (CVD), molecular beam epitaxy (MBE), and atomic layer deposition (ALD).

Next, heat treatment is performed to remove stresses caused during the formation of the piezoelectric thin layer 102 and improve crystal characteristics of the piezoelectric thin layer 102. The heat treatment can be performed at a temperature of approximately 400° C. in an oxygen ($O_2$) or argon (Ar) atmosphere for approximately ten minutes.

Figure 3:
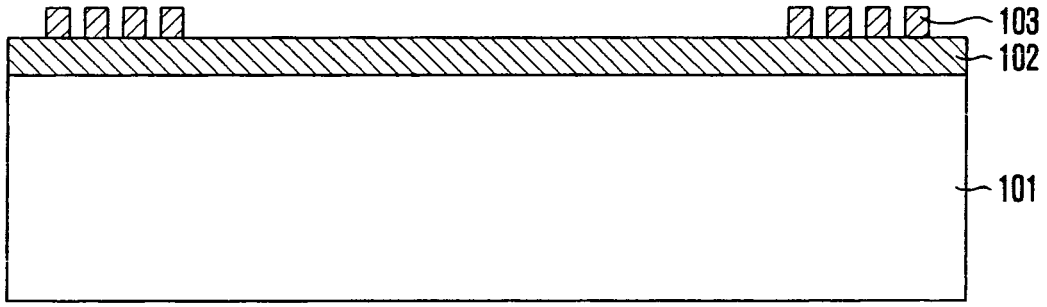

Referring to FIG. 3, a photoresist layer patter is formed on the piezoelectric thin layer 102, and then an IDT electrode conductive layer is deposited on the entire surface of the photoresist layer pattern by E-beam evaporation. The IDT electrode conductive layer can be formed of a conductive material. For example, the IDT electrode conductive layer can be formed of a material selected from the group consisting of gold (Au), silver (Ag), aluminum (Al), platinum (Pt), tungsten (W), nickel (Ni), copper (Cu), and a combination thereof.

Next, the photoresist layer pattern is removed to eliminate unnecessary portions of the IDT electrode conductive layer so as to form IDT electrodes 103 by a lift-off method. Here, various types of IDT electrodes can be formed as the IDT electrodes 103. For example, standard IDT electrodes, single-phase unidirectional transducer (SPUDT) IDT electrodes, IDT electrodes with reflectors, or splitting IDT electrodes can be formed as the IDT electrodes 103 of FIG. 8.

Figure 4:
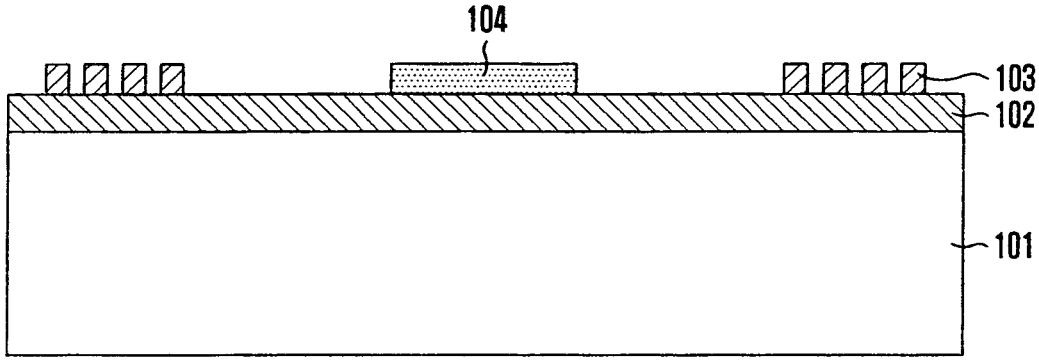

Referring to FIG. 4, a sensor 104 is formed on the piezoelectric thin layer 102. The sensor 104 can be formed using various sensor materials and devices according to detection target substances and the purpose of detection. For example, the sensor 104 can be formed using a material or device capable of detecting biological reaction information using a detection method such as a method of using an antigen-antibody nonspecific reaction or the complementary binding of DNA. For example, the sensor 104 can be formed of a material selected from the group consisting of nanowires, carbon nanotubes, a thin film resistor, quantum dots, a transistor, a diode, and an SAW device.

Figure 5:
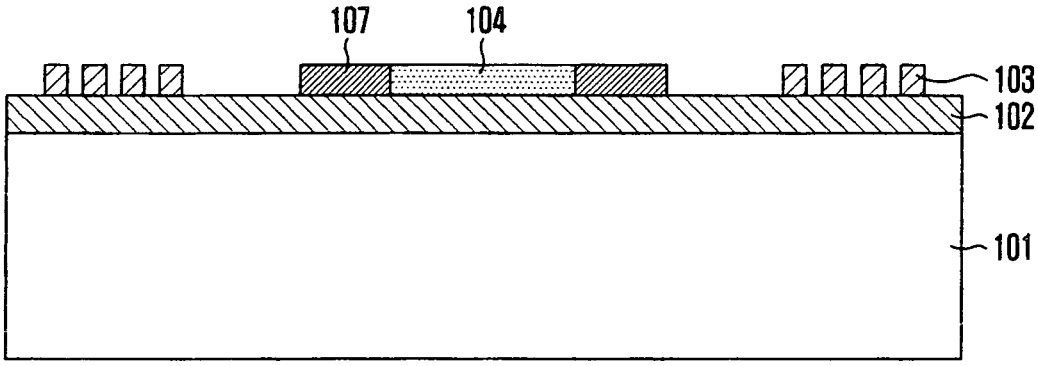

Referring to FIG. 5, fluid passages 105 are formed on the piezoelectric thin layer 102 in connection with the sensor 104. The fluid passages 105 can be formed by forming a passage thin film material on the piezoelectric thin layer 102 and patterning the passage thin film material. The passage thin film material can be formed on the piezoelectric thin layer 102 by a deposition method selected from the group consisting of chemical vapor deposition, E-beam deposition, and sputtering.

The fluid passages 105 may have hydrophobic surfaces to change an injected fluid into micro droplets. For this, the fluid passages 105 can be formed using an organic material such as DLC and silane, or an additional polymer coating process can be performed on the fluid passages 105.

In accordance with the present invention, the SAW-based micro fluidic transportation device includes the piezoelectric thin layer 102 formed by commercialized silicon-based semiconductor manufacturing technology. Therefore, the micro fluidic transportation device can be inexpensive and suitable for mass production. Since the micro fluidic transportation device is inexpensive, is suitable for mass production, and is capable of transporting micro amounts of fluid, the micro fluidic transportation device can be used for various micro fluidic bio apparatuses requiring micro fluidic controlling, such as a PCR chip, a DNA lab-on-a-chip, and a micro biological/chemical reactor.

Figure 6:
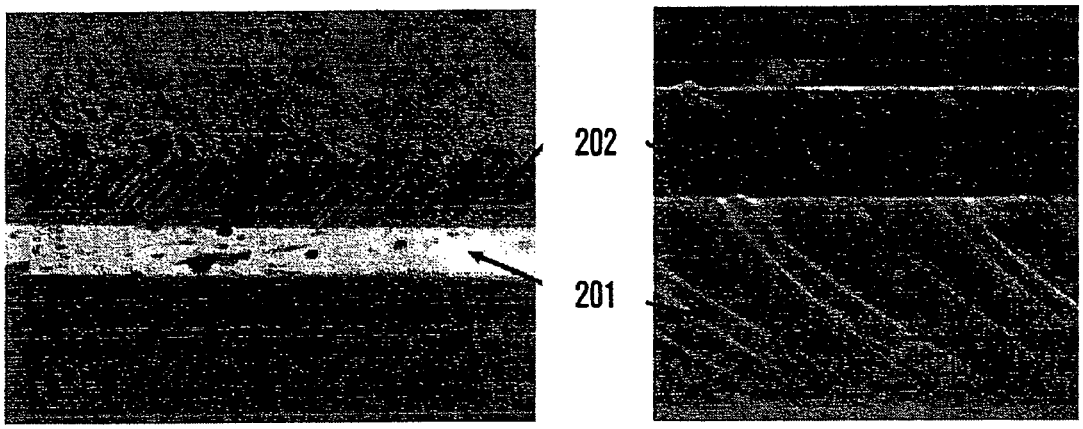
FIG. 6 is scanning electron microscope (SEM) images of sections of a piezoelectric thin layer formed on a silicon substrate.
Figure 7:
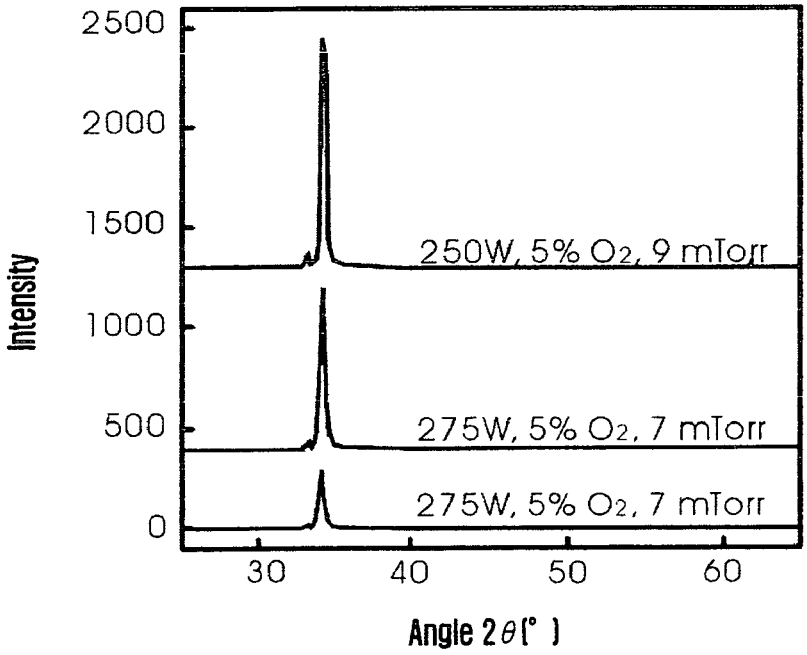
FIG. 7 is an X-ray diffraction analysis graph showing the crystal state of the piezoelectric thin layer of FIG. 6.

FIG. 6 is scanning electron microscope (SEM) images of sections of a piezoelectric thin layer formed on a silicon substrate, and FIG. 7 is an X-ray diffraction analysis graph showing the crystal state of the piezoelectric thin layer of FIG. 6.

Referring to FIG. 6, a ZnO thin layer 202 (a piezoelectric thin layer) is formed on a silicon substrate 201 to a thickness of approximately 2 μl by reactive sputtering. The ZnO thin layer 202 is grown on the silicon substrate 201 and has the same crystal structure as a ZnO substrate (a piezoelectric substrate). That is, the ZnO thin layer 202 has a columnar structure.

Referring to FIG. 7, the crystal planes of the ZnO thin layer 202 are parallel to (002) planes. In the X-ray diffraction analysis graph, a full width at half maximum (FWHM) value was measured at the peak of a curve, and the measured FWHM value was input to the Scherrer equation. In this way, it was found that the grain size of the ZnO thin layer 202 ranged from approximately 20 nm to approximately 40 nm.

In this way, a piezoelectric thin layer having the same crystal structure as a piezoelectric substrate can be formed on a commercialized silicon substrate by a conventional thin layer deposition method such as reactive sputtering. Therefore, since the SAW-based micro fluidic transportation device in accordance with the present invention includes the piezoelectric thin layer instead of including a piezoelectric substrate, the SAW-based micro fluidic transportation device can have at least the same micro fluidic transportation performance as the SAW-based micro fluidic transportation device of Advalytix Company, Germany that includes a piezoelectric substrate.

Figure 8:
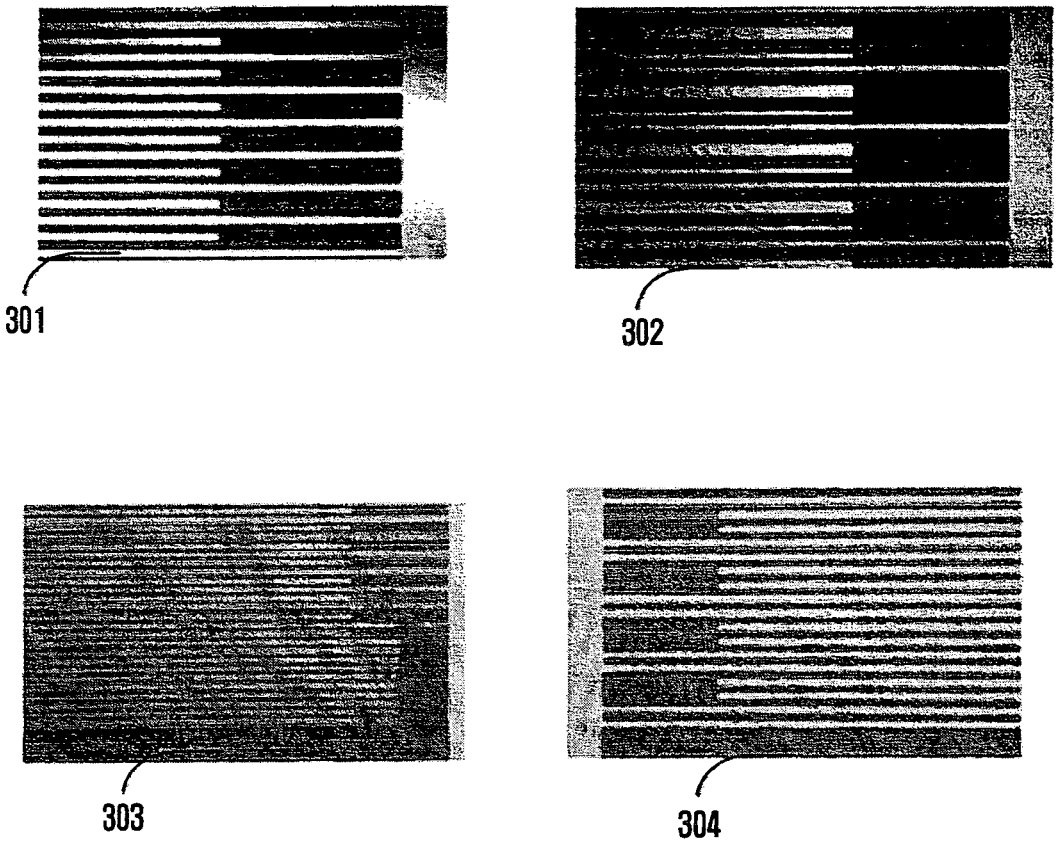
FIG. 8 is images of exemplary inter digitated transducer (IDT) electrodes applicable to the micro fluidic transportation device for energy conversion in accordance with an embodiment of the present invention.

FIG. 8 is images of exemplary IDT electrodes applicable to the micro fluidic transportation device for energy conversion in accordance with an embodiment of the present invention.

As described in FIG. 1, when an electric signal is input to IDT electrodes through input electrodes, piezoelectric distortion occurs at overlapped portions of the IDT electrodes by the piezoelectric effect, and the piezoelectric distortion is transmitted to a piezoelectric thin layer, thereby generating an SAW. Therefore, energy conversion efficiency can vary according to the structure of the IDT electrodes, such as the gap between IDT electrodes and the width and length of the IDT electrodes. Thus, selection of IDT electrodes is important.

Referring to FIG. 8, various types of IDT electrodes that are used in SAW devices for communication applications can be used in the micro fluidic transportation device in accordance with the present invention. For example, standard IDT electrodes 301, SPUDT IDT electrodes 302, IDT electrodes 303 with reflectors, or splitting IDT electrodes 304 can be used in the micro fluidic transportation device in accordance with the present invention.

Resonance characteristics of the IDT electrodes 301, 302, 303, and 304 can be measured using a network analyzer to select those having the highest energy conversion efficiency. In general, the resonance characteristics of the IDT electrodes 301, 302, 303, and 304 can be evaluated by measuring the s-parameters (scattering parameters) of the IDT electrodes 301, 302, 303, and 304. This will now be described in more detail with reference to FIGS. 9 and 10.

Figure 9:
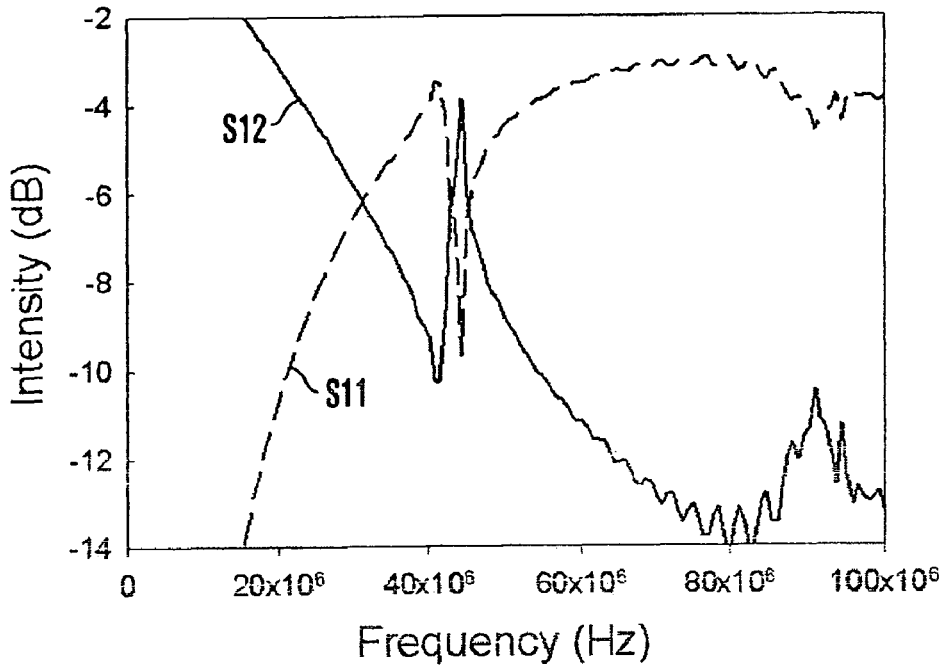
FIGS. 9 and 10 are s-parameter graphs showing the energy conversion IDT electrodes of FIG. 8.
Figure 10:
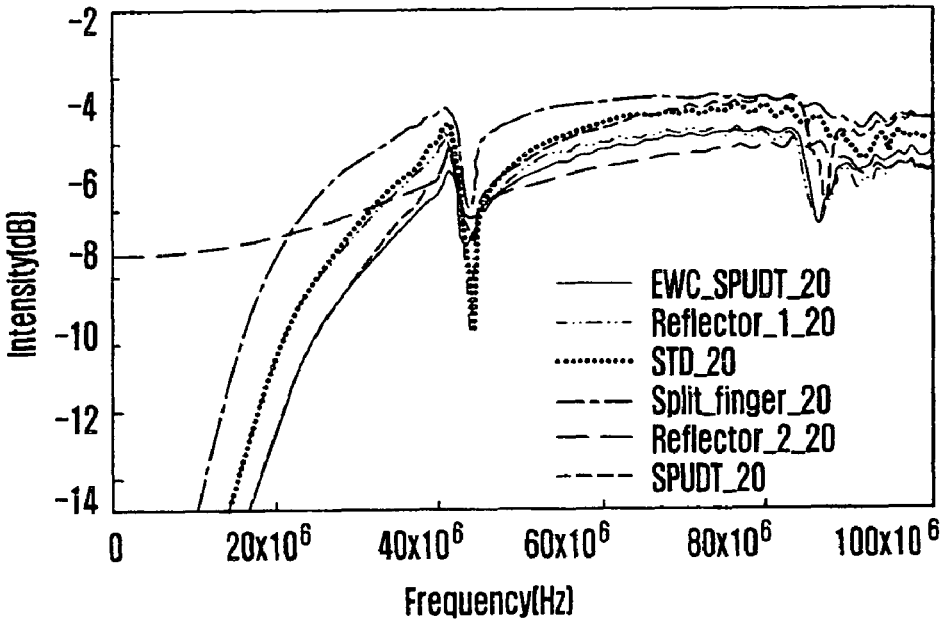

FIGS. 9 and 10 are s-parameter graphs of the IDT electrodes of FIG. 8. FIG. 9 shows the resonance characteristics of the standard IDT electrodes 301. The standard IDT electrodes 301 show resonance characteristics at a specific frequency (43 MHz in FIG. 9). In FIG. 9, the $S_{12}$ curve represents a reverse transfer function when an input side is matched, and the S11 curve represents an input reflection function when an output side is matched.

In this way, the resonance characteristics of the IDT electrodes 301, 302, 303 and 304 can be evaluated by measuring s-parameters of the IDT electrodes 301, 302, 303 and 304 using a network analyzer.

FIG. 10 shows analysis results obtained using a network analyzer for comparing the energy transfer efficiencies of the IDT electrodes 301, 302, 303 and 304 of FIG. 8. Referring to FIG. 10, the IDT electrodes 303 with reflectors and the SPUDT IDT electrodes 302 have energy transfer efficiencies higher than that of the standard IDT electrodes 301.

Figure 11:
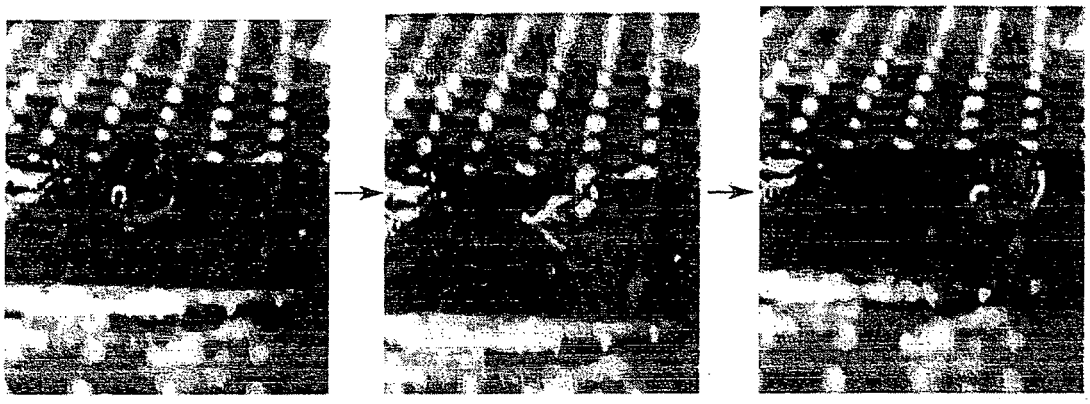
FIGS. 11 and 12 are images showing micro fluidic transportation in SAW-based micro fluidic transportation devices in accordance with the present invention.
Figure 12:
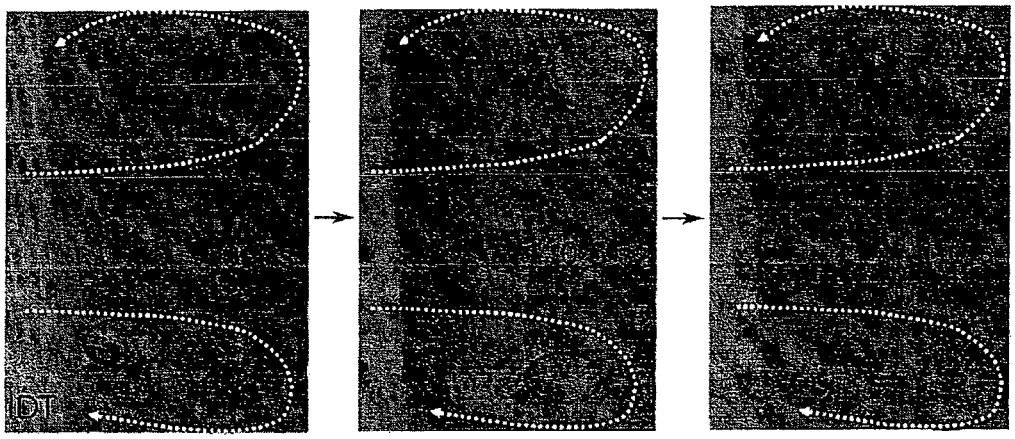

FIGS. 11 and 12 are images illustrating micro fluidic transportation in SAW-based micro fluidic transportation devices in accordance with the present invention.

Referring to FIG. 11, 1 μl of fluid was dropped on a piezoelectric thin layer coated with a hydrophobic material, and then an electric signal such as an RF signal was applied to IDT electrodes. As a result, the micro fluid moved. Here, the micro fluid forms a droplet owing to the hydrophobic material formed on the piezoelectric thin layer. It took 0.1 seconds for the droplet of the fluid to move 1 cm.

Referring to FIG. 12, 50 μl of fluid containing a 10-μm particle was dropped on a piezoelectric thin layer coated with a hydrophobic material, and then an electric signal was applied to IDT electrodes to move the micro fluid in forward, backward, left, and right directions. Furthermore, streams cased by an SAW were detected in the micro fluid. Therefore, when different micro fluids are mixed, the micro fluids can be well mixed owing to the SAW.

The present application contains subject matter related to Korean Patent Application Nos. 2006-0122491 and 2007-0083835, filed in the Korean Intellectual Property Office on Dec. 5, 2006, and Aug. 21, 2007, the entire contents of which are incorporated herein by reference.

While the present invention has been described with respect to certain preferred embodiments, it will be apparent to those skilled in the art that various changes and modifications may be made without departing from the scope of the invention as defined in the following claims.

The invention claimed is:

1. A micro fluidic transportation device, comprising:

a substrate;

a piezoelectric layer formed on the substrate;

a plurality of inter digitated transducer (IDT) electrodes formed on the piezoelectric layer, wherein each of the IDT electrodes are configured for energy conversion by generating a independent surface acoustic wave (SAW); and a plurality of fluid passages formed on the piezoelectric layer having at least a first fluid passage and a second fluid passage, wherein each of the respective SAWs for the respective IDTs electrodes independently control a flow of a sample along the at least first and second respective fluid passage, wherein the sample comprises at least one detector for being controlled along the first fluid passage and at least one micro fluid for being controlled along the second fluid passage.

2. The micro fluidic transportation device of claim 1, further comprising a sensor being between one end of at least a first fluid passage and a second fluid passage, wherein the sensor is configured for receiving the detector and the micro fluid, wherein the sensor is configured for detecting information about a reaction between the received detector and the received micro fluid, wherein the detector and the micro fluid are received after flowing in the at least respective first and second fluid passage.

3. The micro fluidic transportation device of claim 2, wherein the sensor includes one selected from the group consisting of a nanowire, a carbon nanotube, a thin film resistor, a quantum dot, a transistor, a diode, and an SAW device.

4. The micro fluidic transportation device of claim 1, wherein the substrate is formed of a material selected from the group consisting of silicon, glass, plastic, and metal.

5. The micro fluidic transportation device of claim 1, wherein the piezoelectric layer has a thickness ranging from approximately 0.5 μm to approximately 10 μm.

6. The micro fluidic transportation device of claim 1, wherein the piezoelectric layer is formed of a material selected from the group consisting of zinc oxide (ZnO), aluminum nitride (AlN), lithium niobium oxide ($LiNbO_3$), lithium tantalum oxide ($LiTaO_3$), quartz.

7. The micro fluidic transportation device of claim 1, wherein each of the plurality of IDT electrodes are formed of a material selected from the group consisting of gold (Au), silver (Ag), aluminum (Al), platinum (Pt), tungsten (W), nickel (Ni), copper (Cu), and a combination thereof.

8. The micro fluidic transportation device of claim 1, wherein each of the plurality of fluid passages include a hydrophobic surface.

9. The micro fluidic transportation device of claim 1, wherein each of the plurality of fluid passages are formed of one of diamond like carbon (DLC) and silane.

10. A method for manufacturing a micro fluidic transportation device, the method comprising the steps of:

a) forming a piezoelectric layer on a substrate;

b) forming a plurality of IDT electrodes on the piezoelectric layer for energy conversion by generating an independent surface acoustic wave (SAW) for each of the plurality of IDT electrodes; and c) forming a at least two or more fluid passages on the piezoelectric layer, wherein each of the at least two or more fluid passages have one end connected to only one respective IDT electrode for receiving the respective acoustic wave, wherein each of the at least two or more fluid passages have an other end all connected to a sensor.

11. The method of claim 10, wherein the substrate is formed of a material selected from the group consisting of silicon, glass, plastic, and metal.

12. The method of claim 10, wherein the step a) includes the steps of:

a1) depositing a piezoelectric layer on the substrate; and a2) heat-treating the piezoelectric layer to reduce stresses and improve crystal characteristics.

13. The method of claim 12, wherein the step a1) is performed using one selected from the group consisting of reactive sputtering, chemical vapor deposition (CVD), molecular beam epitaxy (MBE), and atomic layer deposition (ALD).

14. The method of claim 12, wherein the step a2) is performed at a temperature of approximately 400° C. in an oxygen ($O_2$) or argon (Ar) atmosphere for approximately 10 minutes.

15. The method of claim 10, wherein the step c) includes the steps of:

c1) depositing a fluid passage layer on the piezoelectric layer; and c2) patterning the fluid passage layer.

16. The method of claim 10, wherein the fluid passage includes a hydrophobic surface.

17. The method of claim 10, wherein the fluid passage is formed of one of DLC and silane.

18. The method of claim 10, further comprising the step of:

d) forming the sensor for detecting information about a reaction between a detector and a micro fluid flowing in the fluid passage.

19. The method of claim 18, wherein the sensor includes one selected from the group consisting of a nanowire, a carbon nanotube, a thin film resistor, a quantum dot, a transistor, a diode, and an SAW device.

20. A micro fluidic transportation device, comprising:

a substrate;

a piezoelectric layer formed on the substrate;

a plurality of inter digitated transducer (IDT) electrodes formed on the piezoelectric layer, wherein each of the IDT electrodes are configured for energy conversion by generating a independent surface acoustic wave (SAW); and a plurality of fluid passages formed on the piezoelectric layer having at least a first fluid passage and a second fluid passage, and wherein each of the at least first fluid passage and the second fluid passage are connected to only one respective IDT electrode.

* * * * *